US009848485B2

(12) United States Patent
Corke et al.

(10) Patent No.: US 9,848,485 B2
(45) Date of Patent: Dec. 19, 2017

(54) METHODS AND APPARATUS FOR PULSED-DC DIELECTRIC BARRIER DISCHARGE PLASMA ACTUATOR AND CIRCUIT

(71) Applicants: UNIVERSITY OF NOTRE DAME DU LAC, Notre Dame, IN (US); Creare LLC, Hanover, NH (US)

(72) Inventors: Thomas C. Corke, South Bend, IN (US); Richard Kaszeta, Hanover, NH (US); Calman Gold, Hanover, NH (US)

(73) Assignees: University of Notre Dame du Lac, South Bend, IN (US); Creare LLC, Hanover, NH (US)

( * ) Notice: Subject to any disclaimer, the term of this patent is extended or adjusted under 35 U.S.C. 154(b) by 0 days.

(21) Appl. No.: 15/374,707

(22) Filed: Dec. 9, 2016

(65) Prior Publication Data

US 2017/0181260 A1 Jun. 22, 2017

Related U.S. Application Data

(60) Provisional application No. 62/273,957, filed on Dec. 31, 2015, provisional application No. 62/268,338, filed on Dec. 16, 2015.

(51) Int. Cl.
*H05H 1/24* (2006.01)

(52) U.S. Cl.
CPC ..... *H05H 1/2406* (2013.01); *H05H 1/24* (2013.01); *H05H 2001/2412* (2013.01)

(58) Field of Classification Search
CPC ..... H05H 1/2406; H05H 1/46; H05H 2001/2412; H05H 2001/2418; H05H 2001/2425; H05H 2001/4692; F05D 2270/172; F05D 2270/18; F05D 2270/52; F05D 2270/3061; B64C 2230/12; B64C 2230/20

See application file for complete search history.

(56) References Cited

U.S. PATENT DOCUMENTS

| | | | | |
|---|---|---|---|---|
| 6,831,421 | B1 | 12/2004 | Bletzinger | |
| 8,091,950 | B2 | 1/2012 | Corke et al. | |
| 8,235,072 | B2 * | 8/2012 | Roy | B64C 23/005 137/825 |
| 8,916,795 | B2 * | 12/2014 | McClure | B64C 23/005 219/121.48 |

(Continued)

OTHER PUBLICATIONS

International Search Report and Written Opinion in related application No. PCT/US2016/065959, dated Feb. 28, 2017, twelve pages.

*Primary Examiner* — Haissa Philogene
(74) *Attorney, Agent, or Firm* — Greenberg Traurig, LLP

(57) ABSTRACT

A plasma generating device intended to induce a flow in a fluid via plasma generation includes a dielectric separating two electrodes and a power supply. The first electrode is exposed to a fluid flow while the second electrode is positioned under the dielectric. The power supply is electrically coupled to a switch and the first and second electrodes. When the power supply is energized by repeated action of the switch, it causes a pulsed DC current between the electrodes which causes the fluid to ionize generating a plasma. The generation of the plasma induces a force with a velocity component in the fluid.

20 Claims, 13 Drawing Sheets

(56) References Cited

U.S. PATENT DOCUMENTS

| | | | | |
|---|---|---|---|---|
| 9,123,845 | B2 * | 9/2015 | Ashpis | H01L 31/042 |
| 2010/0329838 | A1 * | 12/2010 | Greenblatt | B64C 23/005 415/1 |
| 2011/0180149 | A1 | 7/2011 | Fine et al. | |
| 2011/0283477 | A1 | 11/2011 | Ashpis | |
| 2015/0267727 | A1 | 9/2015 | Segawa et al. | |

* cited by examiner 0 psig
0 psig, F=14.0772*V+(-53.1008)
20 psig
20 psig, F=7.6614*V+(-23.7559)
40 psig
40 psig, F=6.2945*V+(-17.7591)
60 psig
60 psig, F=4.3654*V+(-17.7921)
80 psig
80 psig, F=3.0646*V+(-13.4268)
100 psig
100 psig, F=7.1213*V+(-29.389)

METHODS AND APPARATUS FOR PULSED-DC DIELECTRIC BARRIER DISCHARGE PLASMA ACTUATOR AND CIRCUIT

CROSS REFERENCE TO RELATED APPLICATION

This application is related to U.S. Patent Application No. 62/268,338 entitled "Pulsed-DC Dielectric Barrier Discharge Plasma Actuator and Circuit," filed previously on Dec. 16, 2015, and U.S. Patent Application No. 62/273,957 entitled "Methods and Apparatus for Pulsed-DC Dielectric Barrier Discharge Plasma Actuator and Circuit," filed previously on Dec. 31, 2015, the contents of which are incorporated herein by reference in their entirety.

GOVERNMENT LICENSE RIGHTS

This invention was made with government support under SBIR Contract NNX14CC12C awarded by NASA. The government has certain rights in the invention.

FIELD OF THE DISCLOSURE

The present description relates generally to a pulsed direct current powering system for a dielectric barrier discharge (DBD) plasma actuator for flow control.

BACKGROUND OF RELATED ART

Interest in dielectric barrier discharges (DBD) "plasma actuators" for flow control has seen a tremendous growth in the past 15 years in the U.S. and around the world. The reasons for this are likely based on their special features that include being fully electronic with no moving parts, having a fast response time for unsteady applications, having a very low mass which is especially important in applications with high g-loads, being able to apply the actuators onto surfaces without the addition of cavities or holes, having an efficient conversion of the input power without parasitic losses when properly optimized, and the easy ability to simulate their effect in numerical flow solvers.

The predominant DBD configuration used for flow control consist of two electrodes, one uncoated and exposed to the air and the other encapsulated by a dielectric material. For plasma actuator applications, the electrodes are generally arranged in a highly asymmetric geometry.

Referring to FIG. 1, an example configuration for an alternative current (AC) set-up for a prior art AC plasma actuator 10 is shown in FIG. 1. For the AC-DBD operation, the electrodes 102 and 104 are supplied with an AC voltage from the power source 112 that, at high enough levels, causes the air over the covered electrode to weakly ionize. This is typically less than 1 PPM weakly ionized gas. The ionized air appears blue, which is a characteristic of the composition of the air as ionized components of the air recombine and de-excite. The emission intensity is extremely low, requiring a darkened space to view by eye.

The ionized air, in the presence of the electric field produced by the geometry of electrodes 102 and 104, results in a body force vector field that acts on the ambient (non-ionized, neutrally charged) air or other fluid. The body force can be used as a mechanism for active aerodynamic control. In determining the response of the ambient air, the body force appears as a term on the right-hand-side of the fluid momentum equation.

For a single dielectric barrier discharge (SDBD), during one-half of the AC cycle, electrons leave the metal electrode and move towards the dielectric where they accumulate locally. In the reverse half of the cycle, electrons are supplied by surface discharges on the dielectric and move toward the metal electrode. The time scale of the process depends on the gas composition, excitation frequency, and other parameters. In air and at atmospheric pressure, it occurs within a few tens of nanoseconds.

Although the generated plasma is composed of charged particles, it is net neutral because it is created by the ionization of neutral air and an equal number of negative electrons and positive ions exist in the plasma. The charged particles respond to the external electric field, and the electrons move to the positive electrode and the positive ions move to the negative electrode. This movement results in an imbalance of charges on the edges of the plasma that sets up an electric field in the plasma that is opposite to the externally applied electric field. The imbalance of charges on the edges of the plasma is due to the thermal motion of the charged particles in the plasma. The rearrangement of the charged particles continues until the net electric field in the plasma is neutralized.

Enloe et al. studied the space-time evolution of the ionized air light-emission over a surface mounted SDBD plasma actuator using a photo-multiplier tube (PMT) fitted with a double-slit aperture to focus on a narrow 2-D region of the plasma. (Enloe, L. et al., "Mechanisms and Responses of a Single-Dielectric Barrier Plasma Actuator: Plasma Morphology." *AIAA*, Vol. 42, 2004, pp. 589-594.) The slit was parallel to the edge of the exposed electrode and could be moved to different locations over the other electrode that was covered by the dielectric.

FIG. 2 shows a sample time series of the results from Orlov. (Orlov, D. M., *Modelling and Simulation of Single Dielectric Barrier Discharge Plasma Actuators*, Ph.D. thesis, University of Notre Dame, 2006.) The top graph is a visualization of the of the PMT output that was acquired phase-locked with the AC input to the actuator. The lower portion of FIG. 2 shows the AC input supplied to the electrodes over the same time period. The light emission is taken as an indication of the plasma density, which is a good assumption based on the disparate time scales between the recombination time (order of $10^{-8}$ sec) versus the discharge time scale (order of $10^{-3}$ sec).

The explanation for the difference in the emission character in the two half-cycles shown in FIG. 2 is associated with the source of electrons. During the negative-going half cycle, the electrons originate from the bare electrode, which is essentially an infinite source that readily gives them up. In the positive-going half cycle, the electrons originate from the dielectric surface. These apparently do not come off as readily, or when they do, they come in the form of fewer, larger micro-discharges. This asymmetry has been modeled by Boeuf and Orlov and plays an important role in the efficiency of the momentum coupling to the neutrals. (Boeuf, J. et al. "Electrohydrodynamic force in dielectric barrier discharge plasma actuators." *J. Phys. D.: Appl. Phys.*, Vol. 40, 2007, pp. 652-662; Orlov, D., Font, G., and Edelstein, D., "Characterization of Discharge Modes of Plasma Actuators." AIAA J., Vol. 46, 2008, pp. 3142-3148.) It further suggests some optimization can come in the selection of the AC waveform to improve the performance of the plasma actuator.

Wall-mounted AC plasma actuators 10 with an asymmetric electrode design like that shown in FIG. 1, induce a velocity field similar to that of a tangential wall jet. Enloe et al. correlated the reaction force (thrust) generated by the induced flow with the actuator AC amplitude. (Enloe, L., McLaughlin, T., VanDyken, Kachner, Jumper, E., Corke, T., Post, M., and Haddad, O., "Mechanisms and Responses of a Single-Dielectric Barrier Plasma Actuator: Geometric Effects." AIAA, Vol. 42, 2004, pp. 595-604.) A similar experiment was performed by Thomas et al. to investigate parameters in the actuator design. (Thomas, F. et al., "Optimization of SDBD Plasma Actuators for Active Aerodynamic Flow Control," AIAA J., Vol. 47-9, 2010, pp. 2169-2177.) At the lower voltages, the induced thrust of the AC plasma actuator 10 was found to be proportional to $V^{3:5}$ AC. This was first observed by Enloe et al. ("Geometric Effects.") Thomas et al. verified consistency between the reaction force and the fluid momentum by integrating the velocity profiles downstream of the actuator. ("Optimization of SDBD Plasma Actuators") Post found that the maximum induced velocity was proportional to $V^{3:5}$ AC, which is consistent with conserved momentum in the self-similar velocity profile region near the actuator. (Post, M. L., "Plasma actuators for separation control on stationary and unstationary airfoils" Ph.D. thesis, University of Notre Dame, 2004.) At the highest voltages, the thrust change with voltage still appears to follow a power law relation, although the exponent is smaller and not necessarily universally accepted. The voltage at which the power-law exponent changes is a function of the area of the covered electrode, with a smaller area causing the change to occur at lower voltages.

As indicated, the body force produced by AC-DBD plasma actuators occurs over a relatively short portion of the two-halves of the AC cycle. In addition, only the portion where the electrons leave the exposed electrode to be deposited onto the dielectric surface, contributes the significant amount of the net body force. This process of the AC body force generation is often referred to as "big push, little push." It is known that at larger static pressures, with atmospheric pressure being considered part of that set, it is easier to ionize the air using AC. Ionizing the air makes it conductive and thereby responsive to the electric field.

DETAILED DESCRIPTION

The following description of example methods and apparatus is not intended to limit the scope of the description to the precise form or forms detailed herein. Instead, the following description is intended to be illustrative so that others may follow its teachings.

Figure 1:
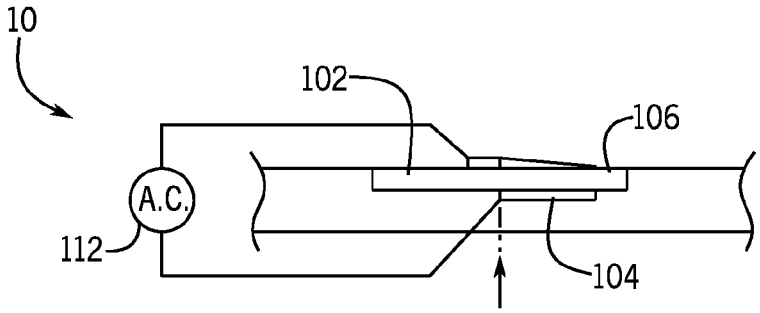
FIG. 1 (PRIOR ART)
FIG. 1 is a schematic of a prior art AC plasma actuator.

Referring now to the figures, FIG. 1 shows an example prior art AC-DBD plasma actuator 10 including a pair of electrodes 102 and 104, a dielectric 106, and a power source 112. The electrodes 102 and 104 are separated by dielectric 106 but both electrically connected to the power source 112 which is capable of producing an AC waveform. The electrodes 102 and 104 are supplied with an AC voltage from the power source 112 that causes the air over the covered electrode to ionize. The ionized air, in the presence of the electric field produced by the geometry of electrodes 102 and 104, results in a body force vector field that acts on the ambient (non-ionized, neutrally charged) air or other fluid. The body force can be used as a mechanism for active aerodynamic control.

Figure 2:
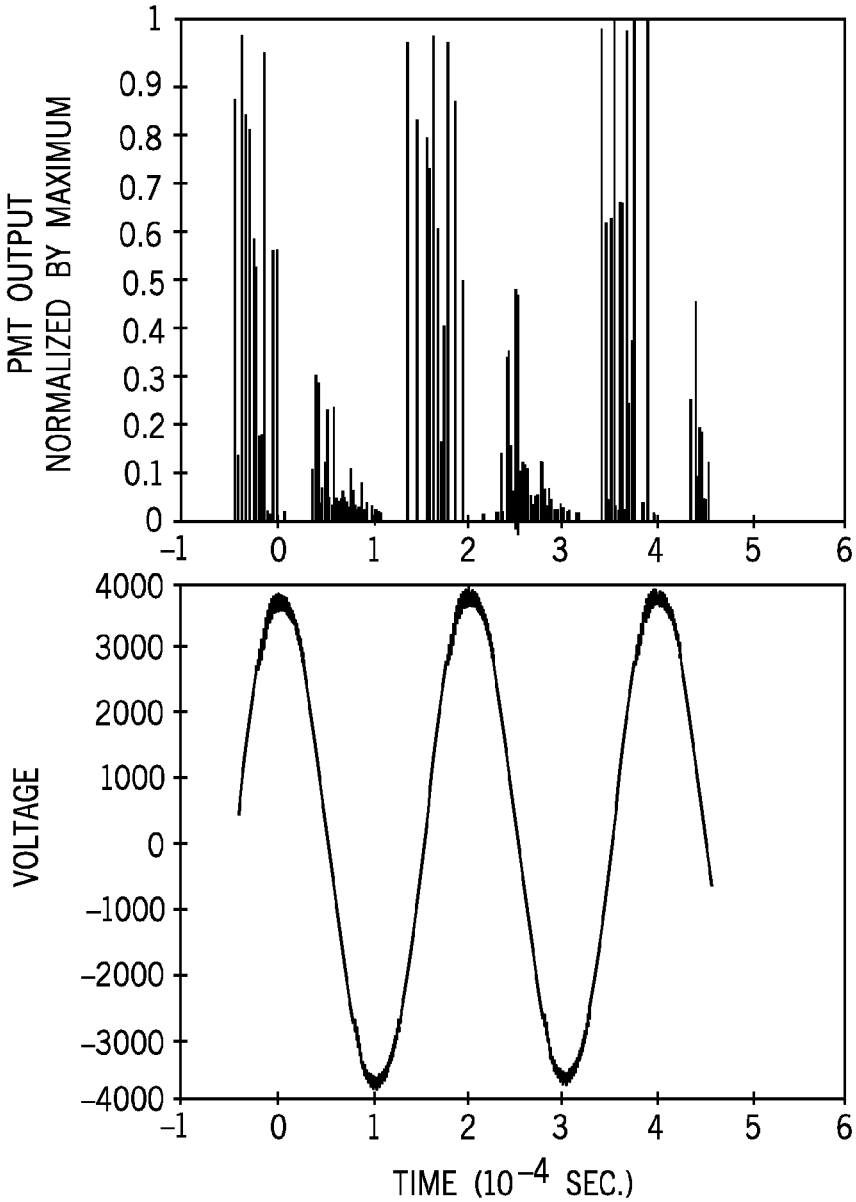
FIG. 2 (PRIOR ART)
FIG. 2 is a graph of the visually observed plasma output compared to the voltage of the prior art AC plasma actuator.

FIG. 2 shows a sample time series of the performance of the prior art AC-DBD plasma actuator 10 that is shown in FIG. 1. The top graph is a visualization of the PMT output that was acquired phase-locked with the AC input to the actuator over approximately 600 microseconds. The lower portion of FIG. 2 shows the AC input supplied to the energized electrodes over the same time period as the upper graph portion.

Figure 3:
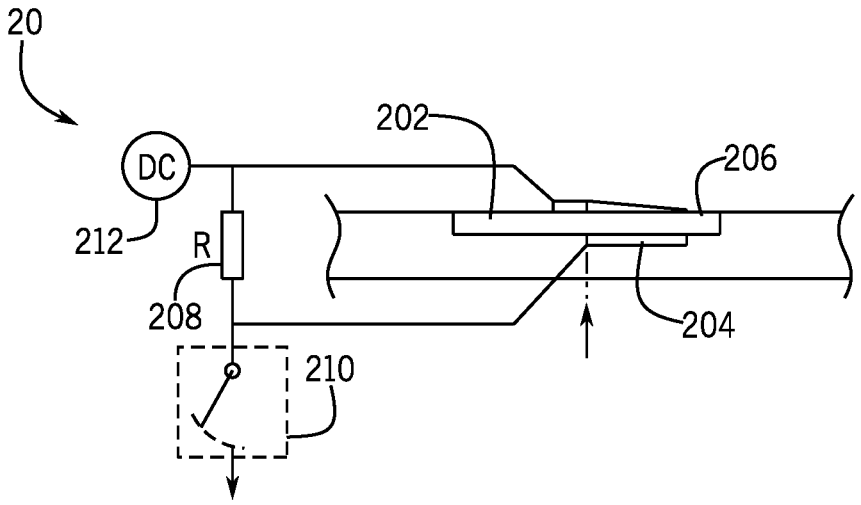
FIG. 3 is a schematic of an example pulsed DC plasma actuator in accordance with the teachings of the present disclosure.

An example pulsed DC plasma actuator 20, disclosed herein, is illustrated as FIG. 3. The example pulsed DC plasma actuator 20 includes a pair of electrodes 202, 204, dielectric 206, a resistor 208, a solid state switch 210, and a DC voltage source 212. The example micro-pulsed DC plasma actuator 20 is meant to be a hybrid approach that embodies at least some of the best aspects of AC and DC plasma actuators. As such, the example pulsed DC plasma actuator 20 arrangement disclosed herein is similar to most typical AC-DBD designs 10, such as shown in FIG. 1, with staggered electrodes 102, 104 that are separated by a dielectric insulator 106. However, for the example plasma actuator 20, shown in FIG. 3, instead of an AC voltage source 112 to drive the actuator, the pulsed-DC utilizes a power source, such as the DC voltage source 212. The DC voltage source 212 is used because DC is better at producing a body force if the air is already ionized. It will be appreciated that this DC source into the device may be accomplished via any suitable power generation including for example, a power converter or a voltage rectifier from an AC source, like the AC power source 112 used in FIG. 1.

As shown in the schematic for the pulsed-DC plasma actuator 20 in FIG. 3, the DC voltage source 212 is electrically connected to both the exposed electrode 202 and the lower electrode 204. Between the electrodes, the resistor 208 limits the current to the lower electrode 204, which is also connected to a fast-acting solid-state switch 210. The solid-state switch 210, when closed, shorts the voltage to the lower electrode to the power supply ground from the DC voltage originally supplied. A periodic trigger signal consisting of a transistor-transistor logic (TTL) pulse is supplied to activate the solid-state switch 210 to deliver the micro-pulses to the electrodes 202, 204. This can be accomplished by an external controller or an internal signal generator. The pulse formed by the DC waveform produced by voltage source 212 and solid state switch 212 is a square wave with a floor of 0 V and a ceiling of the output voltage of voltage source 212. In other examples, the pulse could be varied with frequency modulation to include different pulses lengths, and the DC waveform could also be constructed to regulate and control the voltage at either electrode 202, 204.

While the example pulsed DC plasma actuator 20 is shown extending from the surface in FIG. 3, it will be appreciated that the pulsed DC plasma actuator 20 or any portion thereof may also be inserted into a recessed area of the surface so that it is flush with a surface when installed. This may be required for certain aerodynamic applications, such as wing or rotor placement. For instance, the exposed electrode 202 may be partially covered and the lower electrode 204 may be partially exposed. These electrodes can be composed of any suitable conductive material such as copper, etc. The dielectric insulator 206, in this example, is ULTEM polyetherimide (PEI) tape, but it may also be made of any suitable electrically insulating material, for example, thin and flexible materials such as KAPTON polyamide tape or a thermoplastic film such as PEEK. It will be appreciated that the dielectric insulator 106 may also be a rigid material such as MACOR that is machineable and durable.

In this example, the fast-acting solid-state switch 210 consists of a stacked MOSFET design. The solid-state switch 210 used for the present results was a five device stack. It will be appreciated that the solid-state switch 210 could be any suitably fast switching device. A periodic trigger signal consisting of a TTL pulse was supplied to activate the MOSFET switch.

In the example pulsed DC plasma actuator 20 shown in FIG. 3, the upper electrode 202 is exposed to the air or other fluid passing over the surface of the actuator. The lower electrode 204 is located under the dielectric layer 206. When the pulsed DC plasma actuator 20 is energized, the solid-state switch 210 momentarily grounds the lower electrode 204. The voltage supplied to the electrodes 202, 204 may be static or variable. In the example, both are supplied with the output voltage of the power source 212; in other examples, the voltages may include an offset. If the exposed upper electrode 202 is an anode, electrons flow from conductive material into the dielectric via the ionized fluid. This provides greater force than a reversed arrangement where the exposed upper electrode 202 is a cathode. In the DC plasma actuator 20, this provides superior efficiency by eliminating the reversing cycle of the prior AC plasma actuator 10.

Referring still to FIG. 3, the edges of the exposed upper electrode 202 and the covered lower electrode 204 are overlapped by a small amount in order to produce a more uniform plasma in the full spanwise direction of the surface. If no overlap is provided, the air gap between the electrodes 202 and 204 tends to break down at the applied voltage before the dielectric 206. At atmospheric pressure, almost any available dielectric material has a dielectric strength and breakdown voltage superior to air, and therefore, air gaps typically are avoided in the design of the plasma actuator. If an air gap is present, the result is often a spanwise non-uniformity in the plasma, which tends to reduce the effectiveness of the plasma actuator.

As will be appreciated, the example pulsed DC plasma actuator 20 of FIG. 3 is a single dielectric barrier discharge (SDBD) plasma actuator. The example SDBD plasma actuator is stable at atmospheric pressure and any other pressure because it is self-limiting due to charge accumulation on the surface of the dielectric 206. In other words, the behavior of the pulsed DC plasma actuator 20 is primarily determined by the buildup of charge on the covered, insulated lower electrode 204. When the AC voltage source 212 applies an AC voltage, a plasma discharge appears on the surface of the dielectric 206 above the lower electrode 204 and directed momentum, defined by the body force vector $f_B$, is coupled to the surrounding air. The body force vector $f_B$ may be tailored for a given application through the orientation and design of the geometry of the electrodes 202 and 204. For example, the electrodes 202 and 204 may be designed to produce upstream or downstream oriented wall jets or streamwise vortices.

Figure 4:
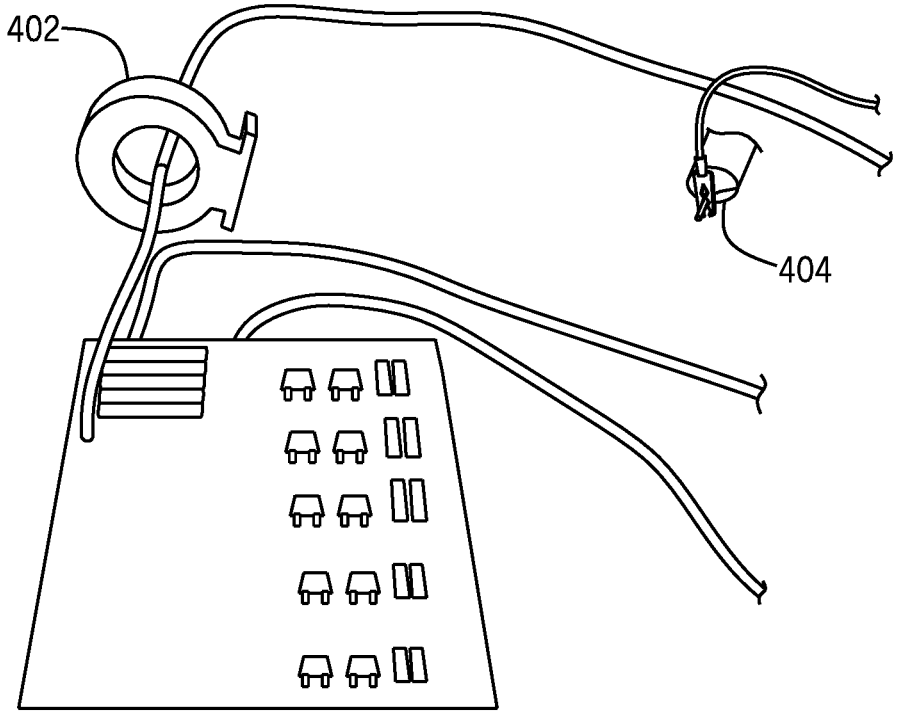
FIG. 4 is an example assembled circuit for testing the pulsed DC plasma.

A picture of an example assembled circuit is shown in FIG. 4 which shows an inductive current sensor 402 and a high voltage probe 404 as part of a test setup for the actuator. The inductive current sensor 402, in this example, is a Pearson Model 2100 seen as the thick ring in the background. The high voltage probe 404 is, in this example, a LeCroy Model PPE 20 kV. These two devices were used to record current and voltage time series supplied to the pulsed DC plasma actuator 20. Analysis of these time series was used to correlate its effect on the thrust performance of the pulsed DC plasma actuator 20. As the DC voltage source, this example used a high-voltage power source as DC voltage source 212, in this example, a Glassman, Model PS/PH050R60-X18 (with a maximum voltage rating of 50 kV, and maximum current limit of 60 mA).

Figure 5:
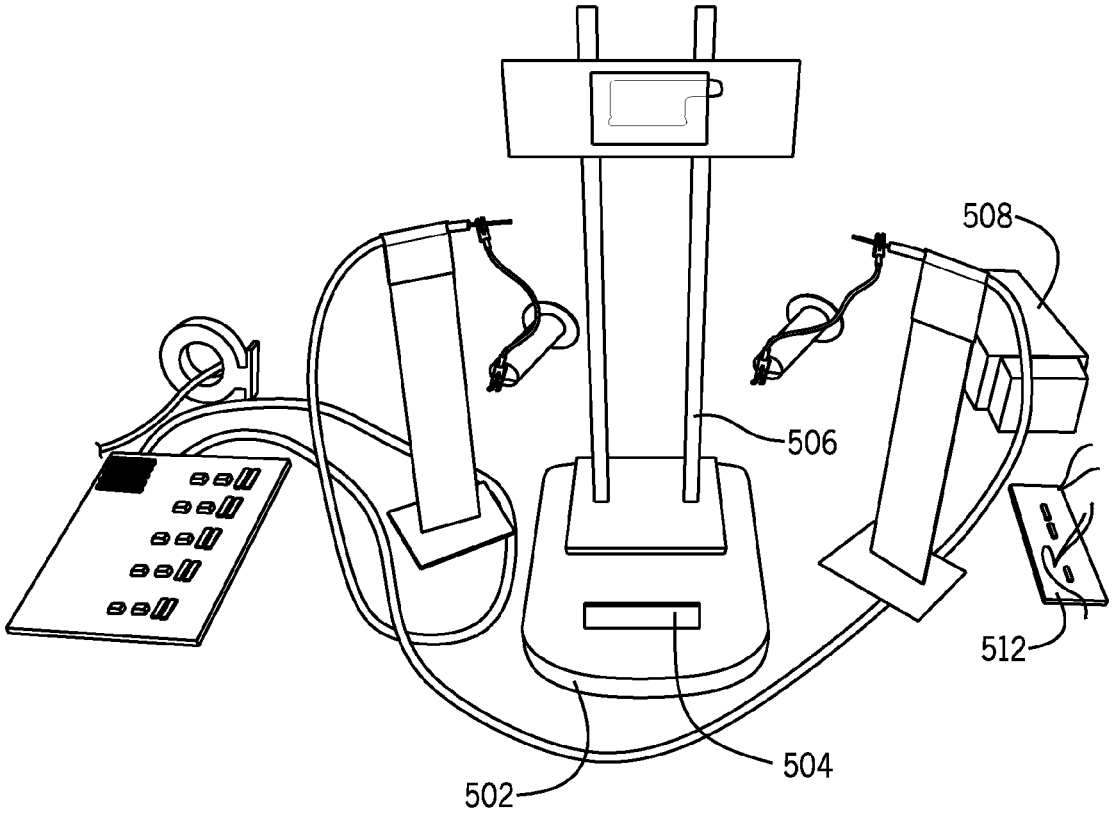
FIG. 5 is an example testing assembly for the pulsed DC plasma actuator.

Referring to FIG. 5, the thrust of the pulsed DC plasma actuator 20 can be measured by the test setup for the plasma actuator thrust measurements that is shown. The test setup includes a scale 502, a truss 506, and a waveform generator 508. The thrust generated by the pulsed DC plasma actuator 20 was measured using the setup shown by mounting the pulsed DC plasma actuator 20 on an electronic force measuring scale 502. The electronic force scale 502 was shielded from possible electronic noise by a covering of copper foil 504. To further minimize electronic noise possibly generated by the plasma actuator operation, the actuator was suspended above the force measuring platen by a wooden truss 506. The distance of the pulsed DC plasma actuator 20 from the electronic force scale was determined in separate experiments to be beyond that where any generated electronic noise by the actuator had any influence on the reading of scale 502. The wire connections to the electrodes 202, 204 were fine gauge coated copper wire. These run between the clips at the ends of the white leads to the electrodes 202, 204 (made of copper in this setup) on the pulsed DC plasma actuator 20.

Figure 6:
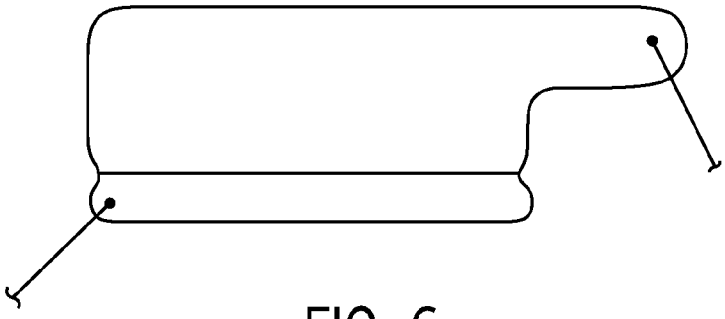
FIG. 6 shows the example pulsed DC plasma actuator of FIG. 3 in operation generating plasma.

As seen on the right side of FIG. 5, the setup includes a variable frequency wave-form generator 508, capable of frequency modulation in its output, and an oscilloscope 510, in this example a 4-channel LaCroy digital oscilloscope (a WaveRunner model 6050A). The waveform generator 508, sometimes referred to as a function generator, provides an input signal to a circuit 512, shown as the white breadboard, that produces a narrow trigger pulse that was supplied to the stacked MOSFET circuit fast-acting solid-state switch 210. The example repetitive pulse created by the energization of the power supply and triggered by the switch 210 is replicated every 1 millisecond. As mentioned above, in other embodiments the wave-form generator 508 could modulate the length of time between pulses to vary the length of time between pulses. A depiction of the plasma generated by the pulsed-DC operation is shown in FIG. 6. There appears to be no discernible differences between the appearance of the plasma in the operation of the DC and AC plasma actuators.

Figure 7:
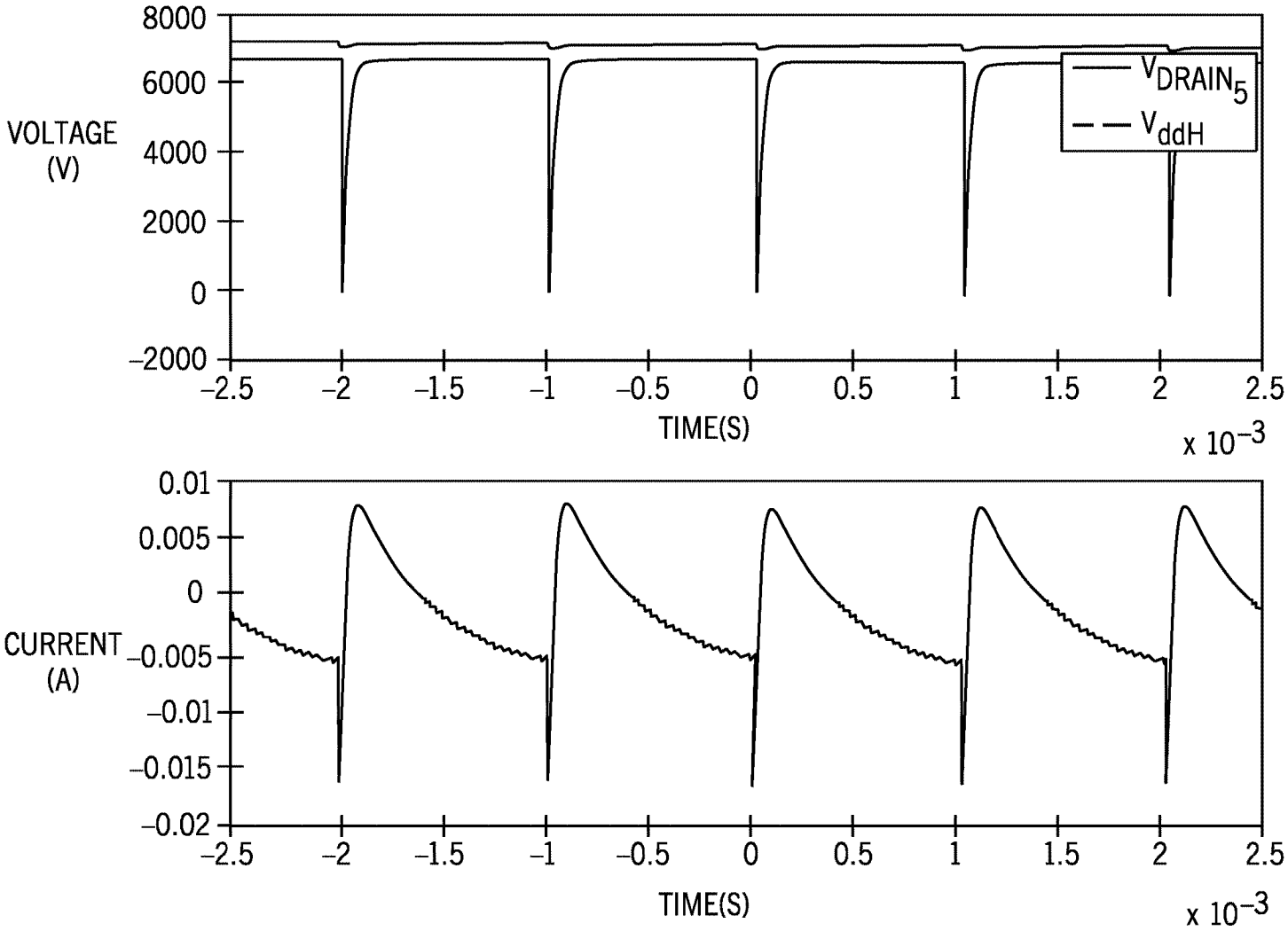
FIG. 7 is a graph of the voltage and current of the example pulsed DC plasma actuator of FIG. 3 over time.

Referring to FIG. 7, the current and high-voltage time series to the pulsed DC plasma actuator 20 during operation were acquired and internally stored by the oscilloscope 510. The oscilloscope 510 can sample at 50106 Samples/s. This monitoring rig had to be extensively modified from its stock configuration to achieve the granularity need to capture the example 0.1 millisecond pulses created by the pulsed DC plasma actuator 20. The data was then transferred to a laptop computer where they were archived and post processed. An example of the simultaneously captured voltage and current time series data is shown in FIG. 7.

FIG. 7 corresponds to a supply voltage, $V_{ddH}$=7000 kV and an actuation frequency of 1000 Hz for a 2.5 in. long actuator. There are similar time series for every thrust measurement data point that will appear in subsequent figures. In FIG. 7, the top plot shows two simultaneous voltage time traces. The trace with the sharp downward peaks is measured at the drain of the last power MOSFET in the chain output of the solid-state switch 212. This is labeled $V_{drain5}$. It corresponds to the voltage time series that is supplied to the covered electrode of the pulsed DC plasma actuator 20. The other voltage time trace labeled $V_{ddH}$ corresponds to the DC voltage that is supplied to the exposed electrode of the plasma actuator. The bottom plot in FIG. 7 corresponds to the time series of the current being supplied to the covered electrode of the pulsed DC plasma actuator 20.

Figure 8:
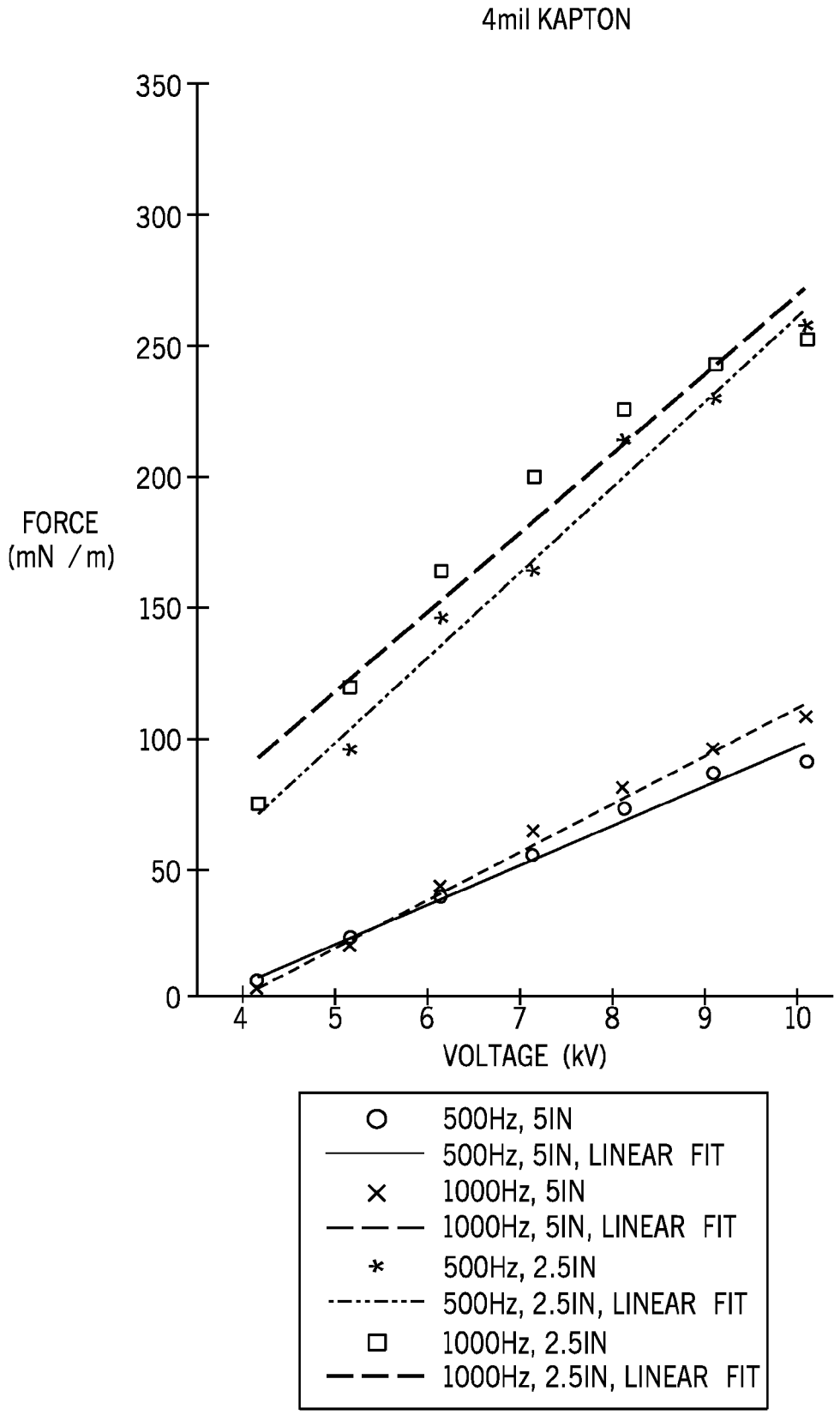
FIG. 8 is a comparison of the force generation of different pulsed DC plasma actuator sizes.

In further experiments, in order to reduce the current through the solid-state switch circuit, the actuator length was decreased by a factor of two, namely from 5 in. down to 2.5 in. The lower two pulsed-DC frequencies were also used to minimize current. The results are shown in FIG. 8. A repeated set of thrust measurements for the 5 in. actuator is shown for comparison. The generated thrust for the 2.5 in. actuator was found to be approximately 3-times that of the 5 in. actuator. One would expect the thrust to scale by the length of the actuator therefore, this is an indication that the previous results were current limited. Therefore, accounting for the length of the actuator, the thrust-per-unit-length of the pulsed-DC plasma actuator 20 is approximately 6-times that of the AC plasma actuator.

Figure 10:
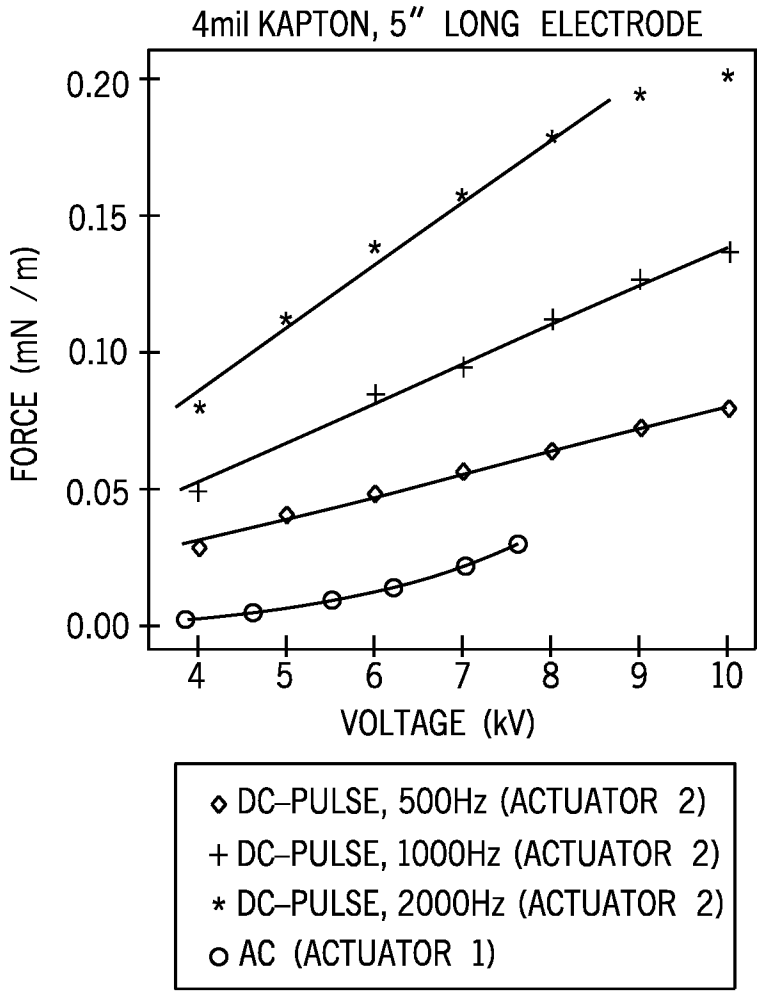
FIG. 10 is a comparison of the force generation of the example pulsed DC plasma actuator (5") with the prior art AC design of FIG. 1 at various voltages.
Figure 9:
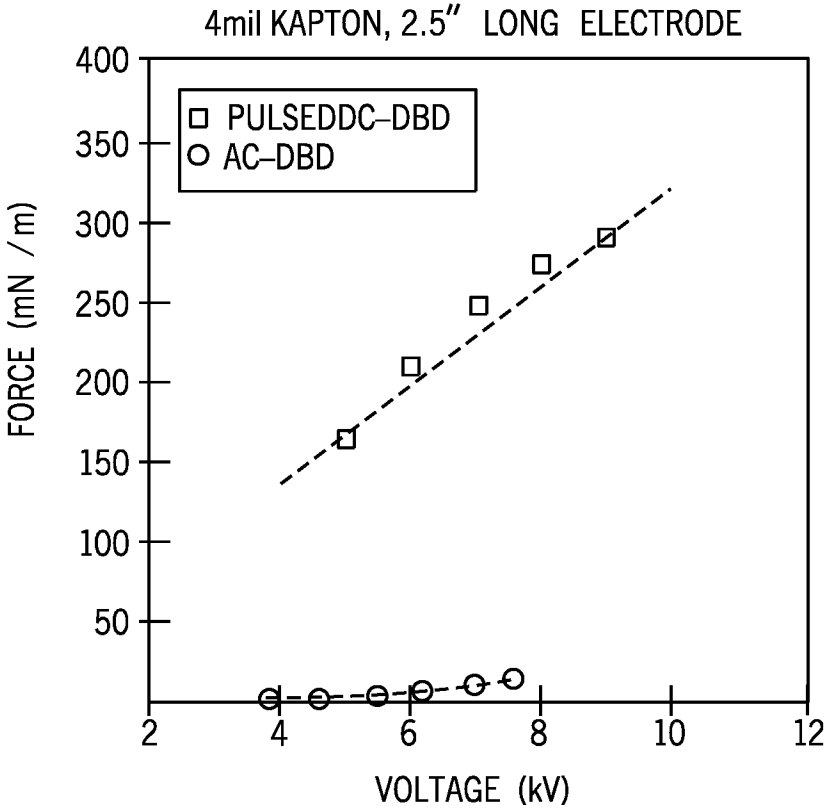
FIG. 9 is a comparison of the force generation of the pulsed DC plasma actuator (2.5") with the prior art AC design of FIG. 1.

Experiments were performed to document the induced thrust produced by a DBD plasma actuator mounted on a force measuring scale in the manner shown in FIG. 5. For this, the pulsed DC plasma actuator 20 consisted of electrodes that were 2.5 in. in FIG. 9 and an electrode length of 5 in. in FIG. 10. The dielectric layer consisted of two, 2 mil. thick layers of Kapton film. The actuator was operated either with an AC input in the manner shown in FIG. 1, or with a pulsed-DC input as shown in FIG. 3. The two approaches were categorized in terms of the amount of induced thrust produced by the two plasma actuator arrangements. The results are shown in FIGS. 9 and 10. For the AC operation, the voltage scale is peak-to-peak voltage. For the pulsed-DC operation it is the DC voltage. During the experiments, the temperature and humidity in the lab were monitored. These were respectively 71F and 35% relative humidity.

The thrust of the AC plasma actuator 10 displays the characteristic power law relation namely, $T \sim V^{3.5}$. In contrast, the thrust generated by the pulsed DC plasma actuator is linear with the input DC voltage. Most notably, the thrust generated by the pulsed-DC plasma actuator operation is more than an order of magnitude larger than that produced by AC operation. In fact, the pulsed-DC thrust levels in FIG. 9 are larger than the largest thrust levels documented with AC plasma actuators, which occurred at 10-times higher voltages.

Figure 11:
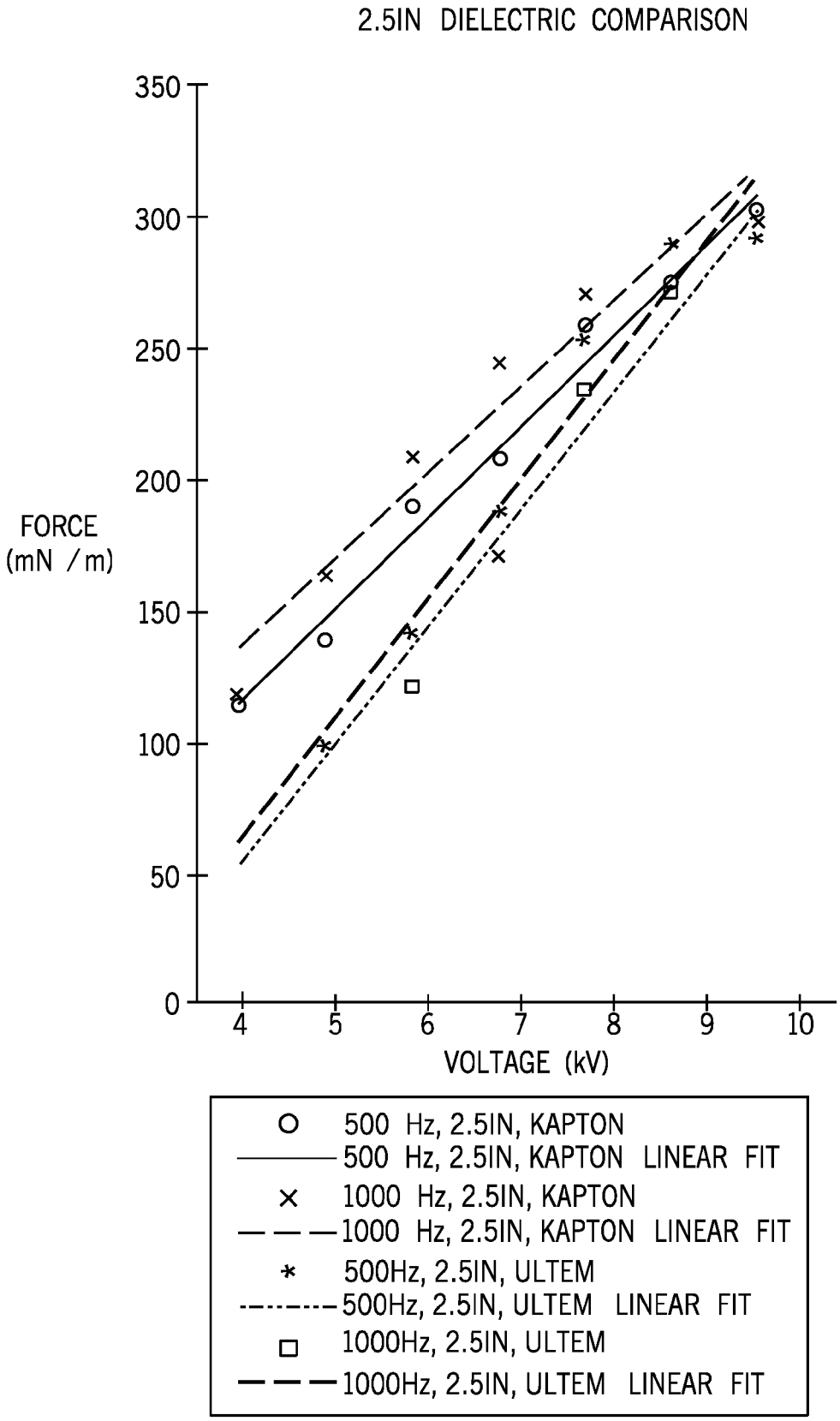
FIG. 11 is a comparison of the force generation using different dielectric materials using different example pulsed DC plasma apparatus.

Referring to FIG. 11, although a Kapton dielectric was used in the previous sample thrust measurements, it generally is not suitable for experiments that operate for long periods of time, since it is degraded by the ozone ($O^3$) generated by the plasma. Another dielectric material used is Ultem film, which is a PolyEtherImide (PEI) that is not affected by exposure to $O^3$. It has a dielectric strength of approximately 3 kV/mil, which is verified in tests. The dielectric strength of Ultem film is approximately half that of the Kapton film, however this is not a critical issue with the lower voltages of the pulsed-DC operation. Experiments were performed to compare the thrust generated with the Ultem film dielectric against those with the Kapton film. The thickness of the Ultem film used in these experiments was 3 mil.

Continuing to referring to FIG. 11, the thrust comparison between the Ultem and Kapton dielectric materials with the 2.5 in. long actuators is shown in the graph. Two pulsed-DC frequencies of 500 Hz and 1000 Hz are presented. In general, the thrust produced with the Ultem dielectric was less than that with the Kapton at the lower voltages. The change in the thrust with voltage was however higher with the Ultem, so that at the higher voltages, the thrust produced with the two different dielectric materials were comparable.

Figure 12A:
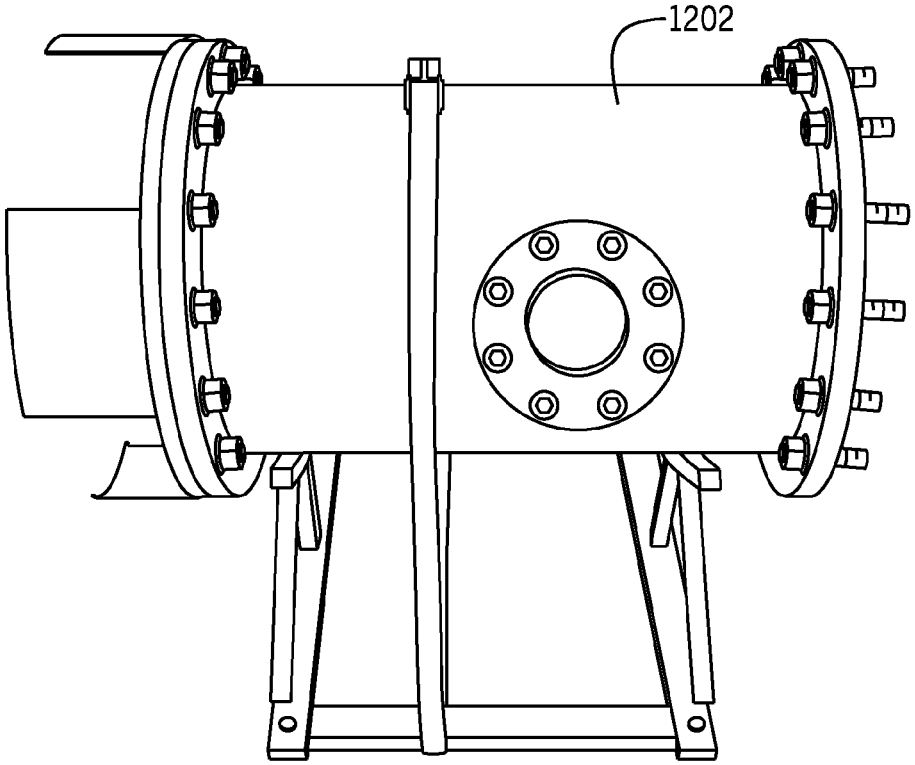
FIG. 12A is an example pressure testing set-up for an example pulsed DC plasma actuator.
Figure 12B:
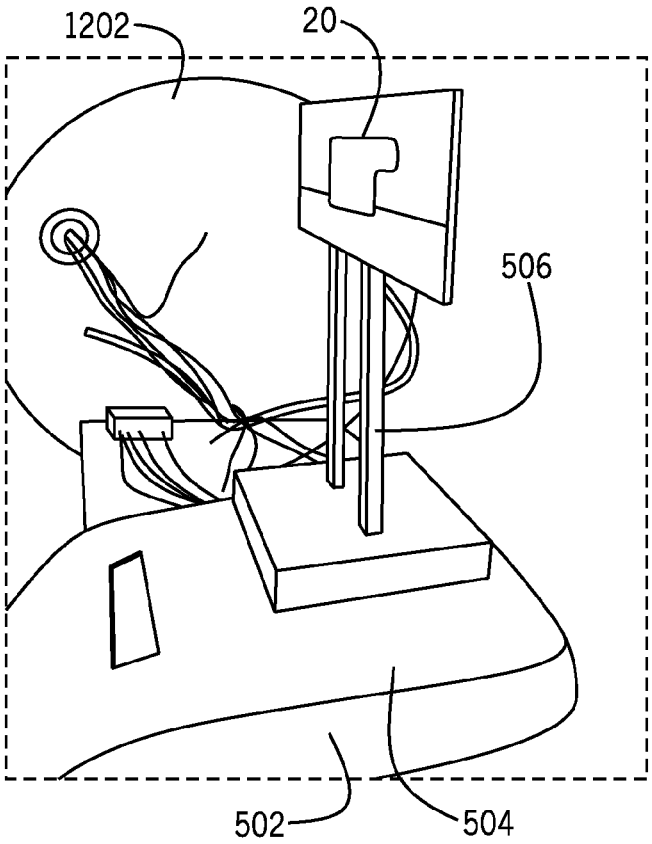
FIG. 12B is an interior view of the example pressure testing set-up for the pulsed DC plasma actuator of FIG. 12A.

Referring to FIGS. 12A-12B, experiments were performed to examine the effect of static pressure on the thrust produced by the pulsed-DC plasma actuator. The experiments consisted of placing the thrust measuring setup shown in FIG. 5 and discussed above inside of a cylindrical pressure vessel 1202. FIG. 12A shows a depiction of the exterior of the pressure vessel 1202 and its interior, with the pulsed DC plasma actuator 20 mounted on the electronic force measuring scale 502. The pressure vessel 1202 was sealed to prevent air leakage when pressurized. The power to the pulsed DC plasma actuator 20 as well as a voltage proportional to the force exerted on the electronic scale 502 were transferred by high-pressure electronic connectors in the pressure vessel wall. A visual reading of the force scale display was also performed through the viewing window in the pressure vessel 1202.

The air pressure inside the vessel 1202, as shown in FIG. 12B, was set using an air compressor and monitored with a dial pressure gauge. The air was filtered with a 1 micron in-line filter. The pressure inside the vessel 1202 was changed slowly, in discrete steps. The temperature of the air inside the chamber was allowed to reach thermal equilibrium with the outside temperature in the laboratory before measurements were taken. This temperature was nominally 25 C. The air in the chamber was frequently purged. In addition, repeatability checks were performed that included purging and re-pressurizing the air in the vessel 1202.

Figure 13:
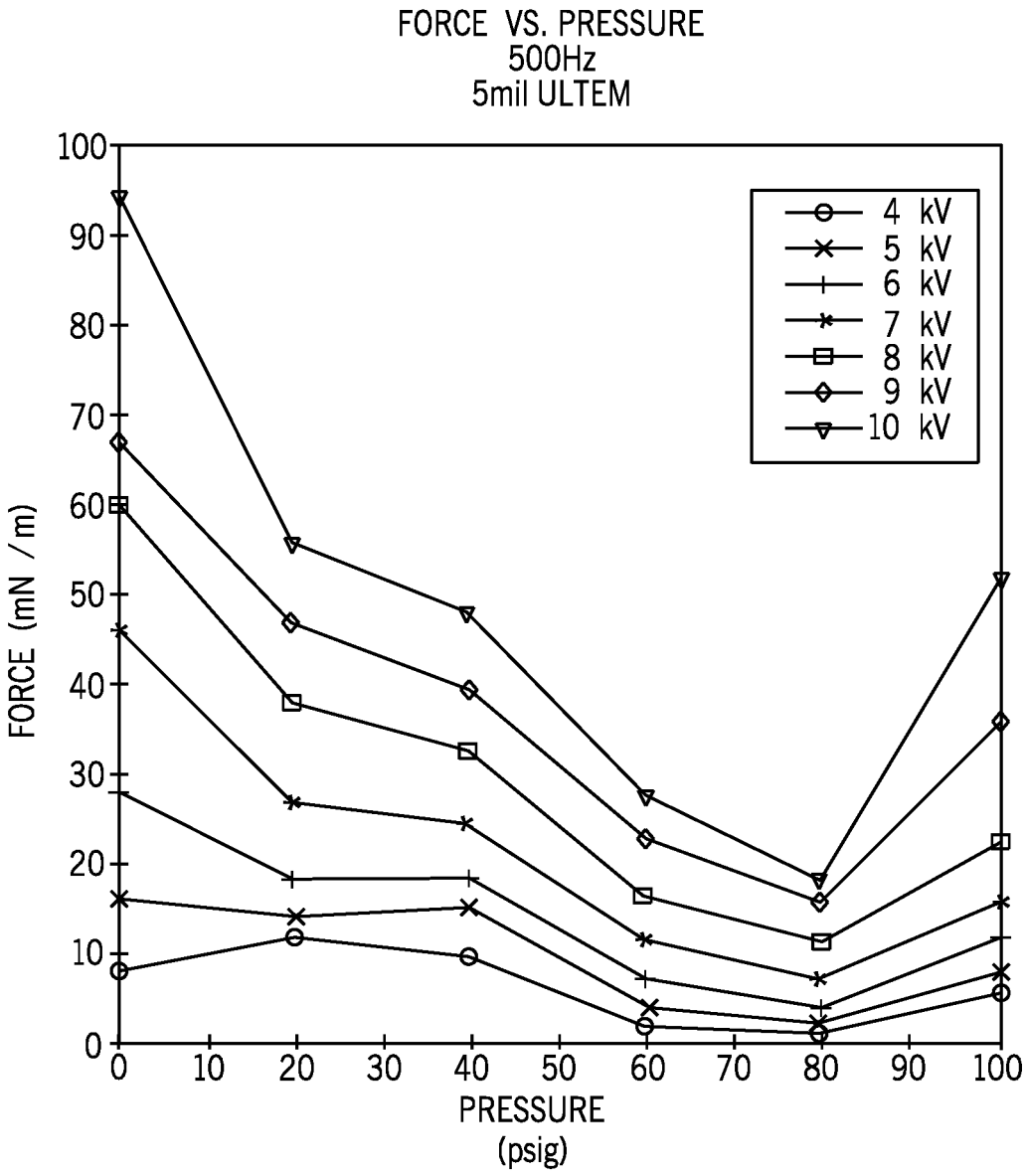
FIG. 13 is a comparison of the induced force of an example pulsed DC plasma actuator at various pressures and voltages.
Figure 14:
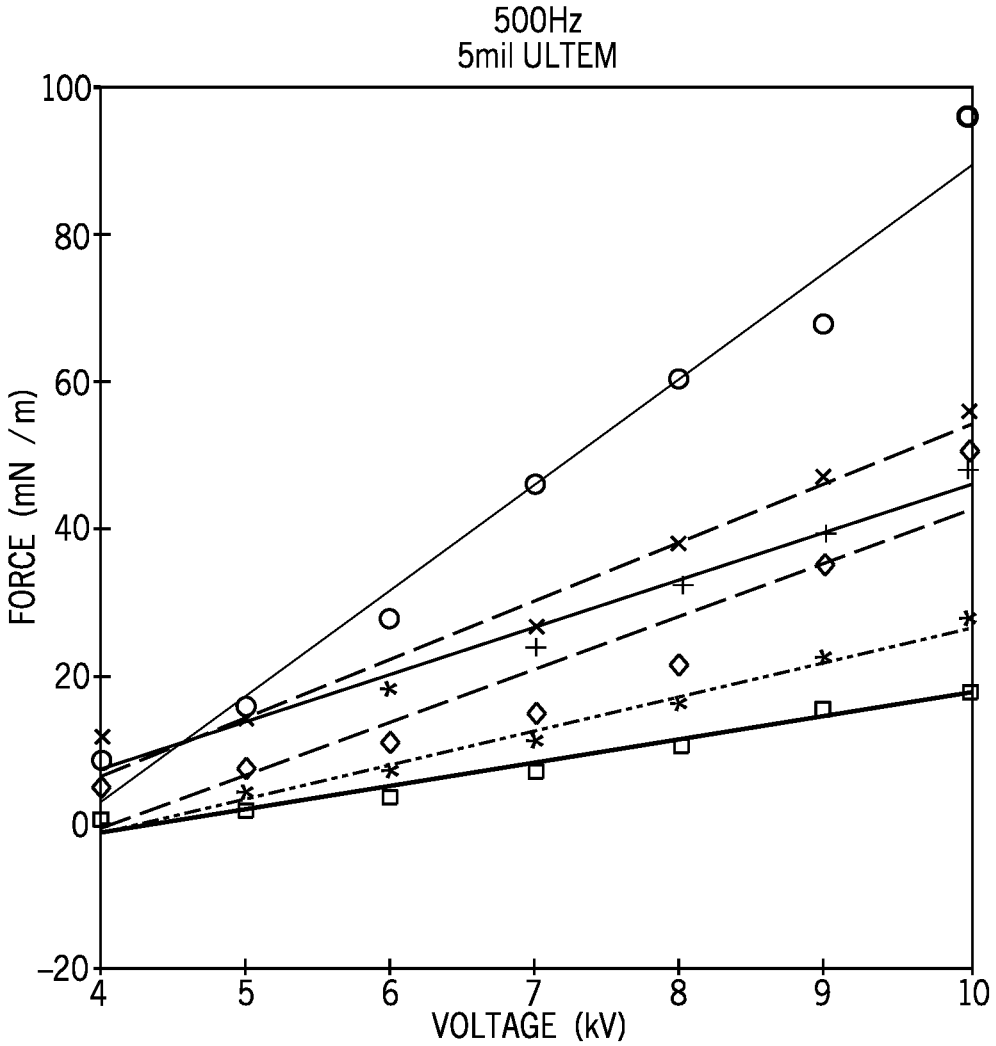
FIG. 14 is a comparison of the slopes derived from the pressure data of FIG. 13 at various voltages.

The results of the pressure tests of the pulsed DC plasma actuator 20 are shown in FIGS. 13 and 14. FIG. 13 shows the change in the generated thrust as a function of the static pressure for different pulsed-DC voltages. At any voltage, the thrust generally decreases with increasing static pressure until it reaches a minimum at approximately 80 psig (6.44 bar), and then begins to increase. This behavior is similar to that found by Valeriotti and Corke for the AC powered plasma actuator, although the pressure of the minimum thrust in that case was at a lower static pressure of 14.7 psig (2 bar). (Valerioti, J. and Corke, T. C., "Pressure Dependence of Plasma Actuated Flow Control." *AIAA J.*, Vol. 50, 2012, pp. 1490.)

Figure 15:
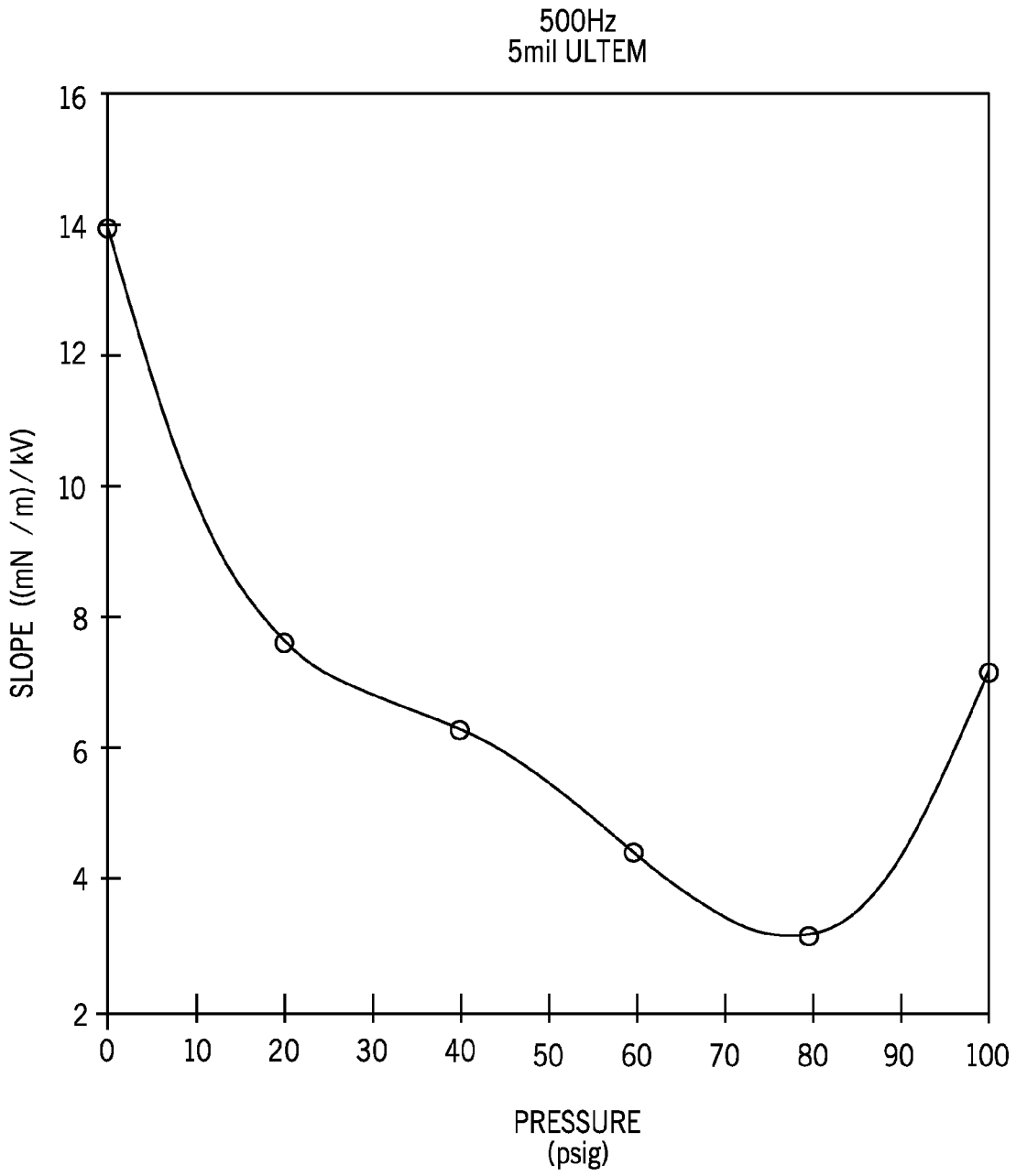
FIG. 15 is a comparison of the slopes derived from the pressure data of FIG. 13 at various pressures.

The data in FIG. 13 was re-plotted in FIG. 14 to illustrate the change in the generated thrust as a function of the DC voltage for the different static pressures. This illustrates that at any of the static pressures, the thrust varies linearly with DC voltage. The slopes of the linear transfer function, $dT=dV_{DC}$ for each of the static pressures is shown in FIG. 15. This mimics the pressure dependence of the thrust at any of the voltage levels that was shown in FIG. 12. This is somewhat in contrast with the AC plasma actuator where the exponent of the power-law relation between the generated thrust and voltage increased with increasing pressure even in the portion up to 2 bar pressure where the thrust was decreasing. The exponent of the AC actuator eventually saturated for pressures above 6 bar.

Figure 16:
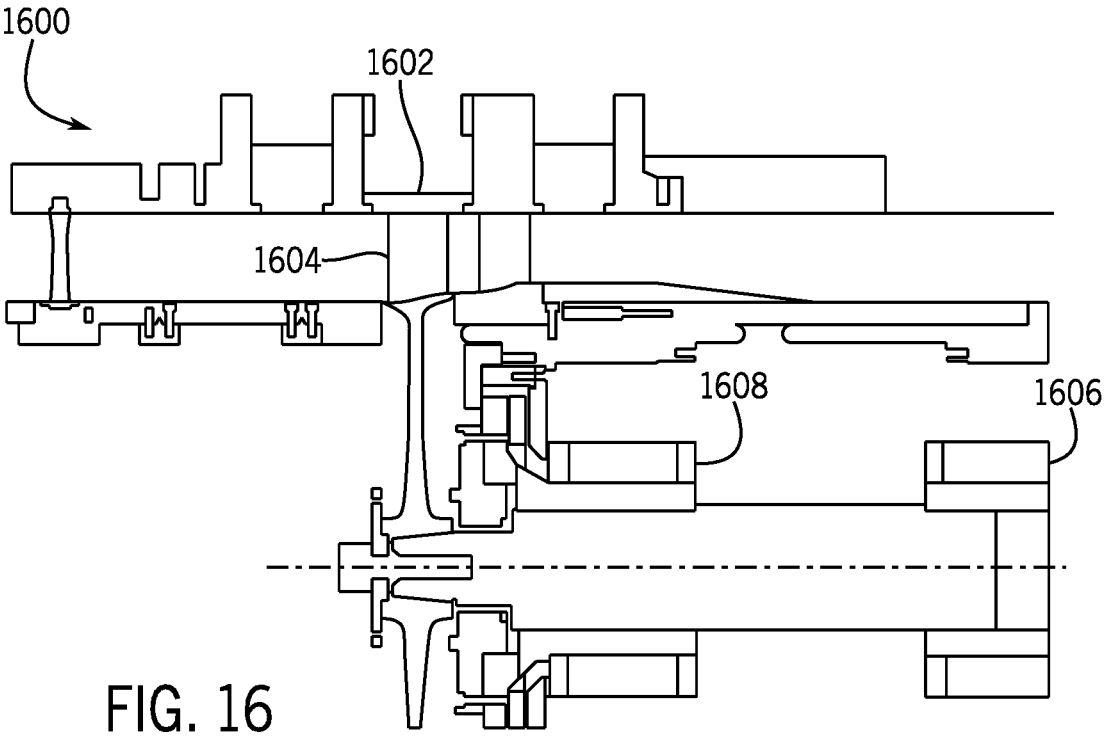
FIG. 16 is a cross-sectional schematic of an example turbo-machine compressor application of pulsed DC plasma actuator.

Referring to FIG. 16, another example of the pulsed-DC driven plasma actuator 20, shown in FIG. 3, is used in a turbo-machine compressor 1600. The turbo-machine compressor 1600 includes a survey ring 1602, a rotor 1604, a gear box 1606, and magnetic bearings 1608. In this example, the pulsed DC plasma actuator 20 is combined with itself as seven additional arc segments of pulsed DC plasma actuator 20 will be added to cover the full azimuth of the survey ring 1602. This 1.5-stage compressor is powered by a 298 kW (400 HP) variable RPM electric motor (not shown) that is connected to the rotor 1604 through a gear box 1606 that spins the rotor up to 15,000 RPM. With a 45 cm. (18 in.) diameter rotor 1604, the tip Mach number at the highest RPM is 1.2. The rotor 1604 spins on magnetic bearings 1608 that provides static and dynamic tip gap control. A cut-away schematic of the flow path design is shown in FIG. 15.

Figure 17:
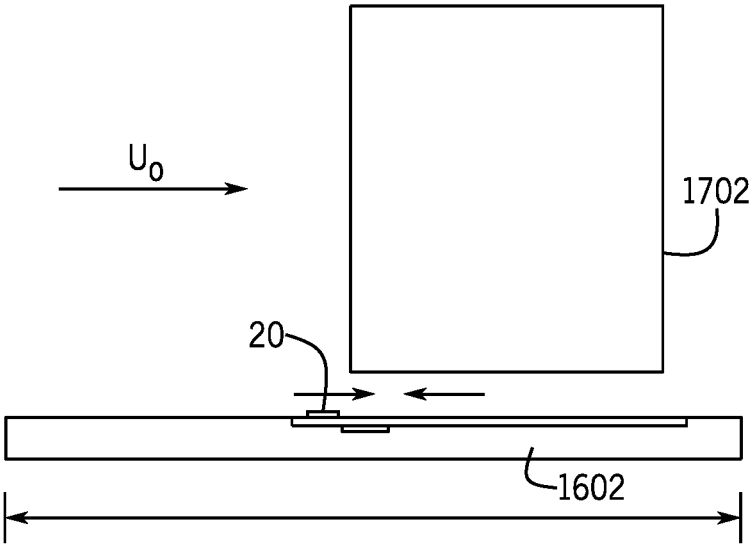
FIG. 17 is a detailed view of the survey ring in the example turbo-machine compressor of FIG. 16 showing the placement of the pulsed DC plasma actuator in this example.
Figure 18:
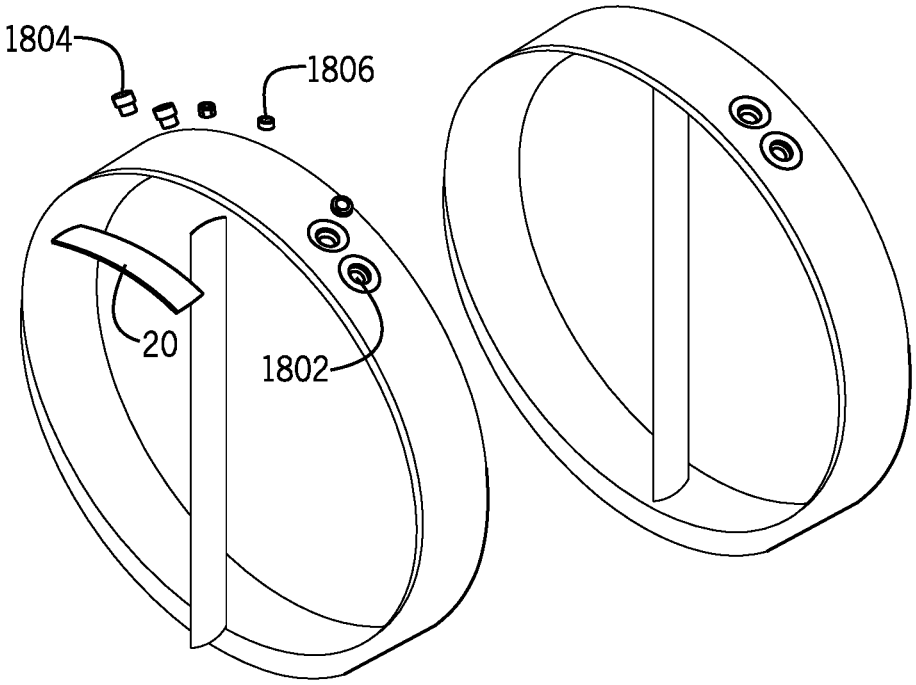
FIG. 18 is detailed illustration of an example survey ring and exploded view of the example survey ring.
Figure 19:
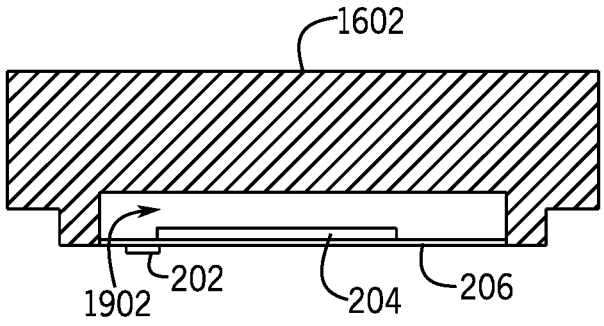
FIG. 19 is a cross-section of the survey ring showing the construction of the example pulsed DC plasma actuator in place in the survey ring of FIG. 18.

Referring now to FIGS. 17-19, extensive experiments have been performed to investigate the effects of circumferential groove casing treatments for stall control. Ross developed a functional relationship between the surge margin extension due to a casing treatment. (Ross, M., *Tip Clearance Flow Interaction with Circumferential Groove Casing Treatment in a Transonic Axial Compressor*., Ph.D. thesis, University of Notre Dame, 2013.) This considered a one dimensional control volume that involved a balance between axial momentum in the tip-leakage flow and the drag force produced by the casing grooves. This is embodied in the following relation:

$$Cd_{cv}Q_O\pi D(x_0-x_{zs})=\eta_r K_{A_c}\tilde{Q}\tau C_{ax}-F_g \tag{1}$$

in which $F_g$ is the drag force produced by the casing grooves, $\tilde{Q}$ is the momentum flux of the tip-leakage flow per unit area, $C_{d_{cv}}$ is the experimentally determined drag coefficient for the control volume, $Q_0$ is the approach flow momentum per unit area, $x_0$ is the virtual origin of the tip leakage jet, $x_{zs}$ is the axial location of the line of zero axial shear, $\pi$ is the pressure ratio across the blade row, $P_{t3}/P_1$, $\tau$ is the tip gap dimension, D is the compressor annulus outer diameter, r is the blade count of the rotor, $C_{ax}$ is the rotor blade axial chord, and $K_{Ac}$ is the actual-to-approximate tip leakage jet axial momentum ratio.

Referring to FIG. 17, the example of the pulsed DC plasma actuator 20 in the turbo-machine compressor 1600 is shown. In this example, we substituted the drag force produced by the casing grooves with the body force produced by the pulsed-DC plasma actuator. This is shown schematically in FIG. 17. The schematic shows what is believed to be the optimum actuator location on survey ring 1602, which is at the leading edge of the row of compressor blades 1702. The choice of this location for the plasma actuator 20 is based on Vo et al. who suggested a criteria for stall inception in which reverse flow in the tip-gap region moves forward (upstream) of the blade row leading edge, designated as $x_{blade_{le}}$ in FIG. 16. (Vo, H., Tan, C., and Greitzer, E., "Criteria for Spike Initiated Rotating Stall." *J. Turbomachinery*, Vol. 130, 2008, pp. 011023.) The actuator location is therefore intended to resist the upstream motion of the reverse flow front. This is believed to be the mechanism by which casing grooves suppress stall.

The upstream edge of the reverse flow on the casing wall that is caused by the tip leakage will be marked by a stagnation line where the wall shear stress is zero. Its location is denoted as $x_{zs}$. Therefore Equation 1 can be rearranged to solve for $x_{zs}$, namely $$\frac{x_{zs}}{C_{ax}}=\frac{x_0}{C_{ax}}-\frac{\eta_r}{\pi}\frac{K_{A_c}}{Cd_{cv}}\frac{\tilde{Q}}{Q_O}\frac{\tau}{D}+\frac{1}{\pi}\frac{F_p}{Cd_{cv}Q_OD} \tag{2}$$

where $F_p$ is the plasma actuator body force. Many of the quantities in Equation 2 such as $\tilde{Q}$, $\pi$, $x_0$, $K_{A_c}$, and $C_{d_{cv}}$ came from Ross for a smooth casing reference. At stall, $x_{zs}=0$, therefore Equation 2 can be solved for $Q_0$ in terms of a known compressor geometry and other constant values known from previous experiments. Having $Q_0$, allows the approach Mach number to be determined by which, assuming isentropic flow relations, the approach flow static pressure, $P_1$, can be found. The total pressure downstream of the rotor, $P_{t2}$, is then found from $P_1(P_{t2}=P_1)$ where $P_{t2}=P_1$ the known pressure ratio across the compressor rotor. Thus, the total pressure rise across the rotor at stall, $\pi_{s2}$, is computed.

Again assuming isentropic flow, the approach static temperature, $T_1$, is found based on the approach flow Mach number and total temperature. The approach flow density, $\rho_1$ is then found assuming an ideal gas relation. Having $\rho_1$ and $Q_0$, the approach flow velocity can be found. Finally with the approach flow velocity, in flow cross-section area, and air density, $\rho_1$, known, the mass flow at stall, $\dot{m}_{s2}$ is determined.

Assuming the same design point performance, the stall margin extension (SME) is defined as the difference between the stall margin with the pulsed DC plasma actuator 20 (subscript 2) and that with the smooth casing without the actuator (subscript 1). This is given by Equation 3.

$$SME=\frac{\pi_d}{\dot{m}_d}\left(\frac{\dot{m}_{s_1}}{\pi_{s_1}}-\frac{\dot{m}_{s_2}}{\pi_{s_2}}\right) \tag{3}$$

A Matlab script was generated to solve Equations 2 and 3, as well as perform the other ancillary calculations needed in their solution. Based on actuator body force of 300 mN/m shown in FIG. 9, a stall margin extension of 3.4% was obtained by the active intervention of one example of the pulsed DC plasma actuator 20. This equation shows that the pulsed DC plasma actuator 20 can be used to dynamically suppress traveling stall cells.

Referring to FIGS. 18-19, a schematic drawing of the pulsed DC plasma actuator 20 implementation for stall control is shown installed on the survey ring 1602 such as that shown in FIG. 16. The pulsed DC plasma actuator 20 is located in a specially designed survey ring 1602 that becomes part of the outer casing of the turbo-machine compressor 1600 directly over the compressor rotor 1604. In this example implementation, the actuator assembly covers only 41.6° arc segment of the ring. Of this, the plasma actuator length covers 31.8°.

As shown in FIG. 18, ports 1802 are placed in the survey ring 1602 to accept pairs of pressure transducers 1804 on both azimuthal sides of the pulsed DC plasma actuator 20. The purpose of these pressure transducers 1804 is to detect the passage of traveling stall cells that are known to form prior to a fully stalled condition. Fasteners 1806 are used to secure the pieces of survey ring 1602 together, which can be other mechanical fasteners, chemical adhesives, or neither.

Referring to FIG. 19, the implementation of plasma actuator 20 into the design of the turbo-machine compressor 1600 involves machining an azimuthal cavity around the inside of the survey ring 1602. The cavity will be filled by an electrically insulating ring that has an azimuthal recess to allow the insertion of a copper lower electrode 204. The copper electrode, in this example, is split into in azimuthal segments, or may cover the complete circumference, depending on the scale and design of the pulsed DC plasma actuator 20. The insulating ring 1902 with the inset copper covered electrode 204 in this example is covered by 2-4 mil thick Ultem tape. This total assembly is flush with the inside wall of the survey ring 1602, which forms the casing wall over the rotor 1604. The exposed electrode 202 will be attached to the surface of the Ultem tape. Again, the design allows for full flexibility in the location and orientation of the exposed electrode 202 in order to control the induced flow to the needs of the situation.

The materials in the example shown in FIGS. 18-19 were chosen based on their electrical and mechanical properties. The materials that are inset in the aluminum survey ring 1602 all have a coefficient of thermal expansion that is close to, but slightly larger than that of aluminum. Therefore, as the compressor 1600 heats up during operation, the aluminum survey ring 1602 will remain tight and not over-stress the survey ring. As mentioned above, the Ultem tape for the dielectric layer 206 has excellent electrical properties for the pulsed DC plasma actuator 20. Ultem has been utilized in numerous plasma flow control experiments. The exposed electrode 202 extends approximately 1 mil (0.001 in) above the casing wall. The nominal tip-gap between rotor 1604 and survey ring 1602 in this example is 0.020 in.

In the example shown in FIGS. 16-19, the velocity vector imparted on the fluid is used to control the lift of the of the compressor blades 1702. The pulsed DC plasma actuator 20 can also be used dynamically to control the flow of the air flowing over the compressor blades 1702. It will be appreciated that this use and its specific parameters pertain to just one example of the application of the pulsed DC plasma actuator 20. Similarly, the dynamic flow control of the pulsed DC plasma actuator 20 can be used to improve heat conductivity in an air duct, reduce dynamic stall, or reduce turbulent fluid flows that cause noise in a helicopter rotor, airplane landing gear, or within an AC system. The pulsed DC plasma actuator 20 can be used to reduce drag on the surface by manipulating the fluid flow increasing range and efficiency of ground or air based vehicles. The drag reduction can also be used to prevent frictional heating of a hypersonic vehicle in flight. The force imparted by the pulsed DC plasma actuator 20 can be used to initiate convective airflows even in a sealed environment or provide a small amount of propulsion to a satellite at high orbit. The pulsed DC plasma actuator 20 can also be used to efficiently generate plasma for dynamic electromagnetic shielding. In addition to these uses of the pulsed DC plasma actuator 20, one of ordinary skill in the art will be able to apply the induced flow created by the pulsed DC plasma actuator 20 for other uses and in other applications including plasma generation, control of separated flow, stall reduction, motionless airfoils, thrust generation, or a number of other uses. Further, it will be appreciated that the parameters of the example apparatus may be varied to suit the situation where the plasma actuator 20 is being used.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A plasma generating device comprising:

a dielectric;

a first electrode exposed to a fluid flow;

a second electrode separated from the fluid flow by the dielectric;

a direct current power supply providing a first voltage to the first electrode and a second voltage to the second electrode; and a switch electrically coupled to the first and second electrodes and to the direct current power supply such that energization of the direct current power supply by action of the switch causes the fluid to generate a plasma between the first electrode and the second electrode and the plasma induces a velocity component in the fluid;

wherein the energization caused by the switch creates a repetitive pulse having a length of time by momentarily connecting one of the first or second electrodes to a ground, such that, for the majority of the pulse, the voltages of the first and second electrodes are the first and second voltages, respectively.

2. The plasma generating device of claim 1, wherein for the majority of the pulse, the first and second voltages are approximately equal.

3. The plasma generating device of claim 1, wherein the repetitive pulse is regularly repeated such that the length of time of the repetitive pulse is approximately 1 millisecond.

4. The plasma generating device of claim 1, where the repetitive pulse is subject to frequency modulation varying the length of time between the repetitive pulses.

5. The plasma generating device of claim 1, wherein the switch is a fast acting solid state switch.

6. The plasma generating device of claim 5, wherein the switch is a stacked MOSFET circuit.

7. The plasma generating device of claim 1, wherein the direct current power supply is an alternating current device adapted to provide direct current to the plasma generating device.

8. The plasma generating device of claim 1, wherein the dielectric comprises a minimally conductive material.

9. The plasma generating device of claim 1, wherein the first electrode is the positive electrode.

10. The plasma generating device of claim 1, wherein the plasma generating device is adapted to reduce drag of the fluid on a surface upon which the plasma generating device is placed.

11. The plasma generating device of claim 1, wherein the plasma generating device is adapted to control flow separation of the fluid over a surface upon which the plasma generating device is placed.

12. The plasma generating device of claim 1, wherein the plasma generating device is adapted to modify the velocity distribution over a surface upon which the plasma generating device is placed.

13. The plasma generating device of claim 1, wherein the plasma generating device is adapted to induce a force on a surface upon which the plasma generating device is placed.

14. A method for generating plasma comprising:

coupling a plasma generating device to a surface, wherein the plasma generating device comprises:

a dielectric;

a first electrode exposed to a fluid flow;

a second electrode separated from the fluid flow by the dielectric;

coupling the first and second electrodes to a power supply, which supplies the first electrode with a first voltage and the second electrode with a second voltage;

energizing the power supply by the action of a switch which delivers a direct current flow generating a plasma between the first electrode and the second electrode;

inducing a velocity component in the fluid;

wherein the direct current flow creates a repetitive pulse having a length of time by momentarily connecting one of the first or second electrodes to a ground such that, for the majority of the pulse, the voltages of the first and second electrodes are the first and second voltages, respectively.

15. The method of claim 14, wherein the repetitive pulse is regularly repeated such that the length of time of the repetitive pulse is approximately 1 millisecond.

16. The method of claim 14, wherein the repetitive pulse is subject to frequency modulation varying the length of time between the repetitive pulses.

17. The method of claim 14, wherein the switch is a fast acting, solid state switch.

18. The method of claim 14, wherein the direct current power supply is an alternating current device adapted to provide direct current to the plasma generating device.

19. The method of claim 14, wherein the dielectric comprises a minimally conductive material.

20. The method of claim 14, wherein the first electrode is the positive electrode.

* * * * *